United States Patent [19]

LeFebvre et al.

[11] Patent Number: 4,732,378

[45] Date of Patent: Mar. 22, 1988

[54] PORTABLE KARATE BREAKING-BOARD HOLDER

[76] Inventors: Arthur G. LeFebvre, 1100 Industrial Blvd. L-5, Chula Vista, Calif. 92011; Michael R. Lamb, 6367 Cleo St., San Diego, Calif. 92104

[21] Appl. No.: 904,893

[22] Filed: Sep. 8, 1986

[51] Int. Cl.[4] ..... A63B 69/00

[52] U.S. Cl. ..... 272/76

[58] Field of Search ..... 272/76; 211/34; 212/142.1; 248/359 R, 451; 108/152, 146

[56] References Cited

U.S. PATENT DOCUMENTS

| | | | |
|---|---|---|---|
| 801,468 | 10/1905 | Lynch | 248/451 |
| 4,171,803 | 10/1979 | Smith | 272/76 |
| 4,492,170 | 1/1985 | Solomon | 108/146 X |
| 4,572,504 | 2/1986 | Di Bartolo | 272/76 |
| 4,583,730 | 4/1986 | Gecht et al. | 272/76 |
| 4,618,192 | 10/1986 | Kelley | 108/152 X |

OTHER PUBLICATIONS

Black Belt Magazine, Jan-1976, Martial Arts Supplies Co., "Power Fist", p. 18.

*Primary Examiner*—Richard J. Apley
*Assistant Examiner*—David Bender
*Attorney, Agent, or Firm*—Jennings, Engstrand & Henrikson

[57] ABSTRACT

A portable Karate breaking-board holder, having an elongated-shaped frame, having an elongated top plate, elongated bottom plate spaced beneath the top plate and an elongated fence plate perpendicularly disposed between and attached to both the top and bottom plates. The fence plate defines distal and proximal recesses between the top and bottom plates. The breaking-board holder further includes board seating mechanism disposed along the distal edges of the top and bottom plates for seating at least one breaking-board in a plane at an angle to a plane perpendicular to one of the top and bottom plates. The breaking-board holder further includes an attaching mechanism coupled to the I-shaped frame which secures at least one breaking board to the distal edges to said top and bottom plates. Finally, handles are coupled to the I-shaped frame within the proximal recess.

9 Claims, 10 Drawing Figures

FIG.-1
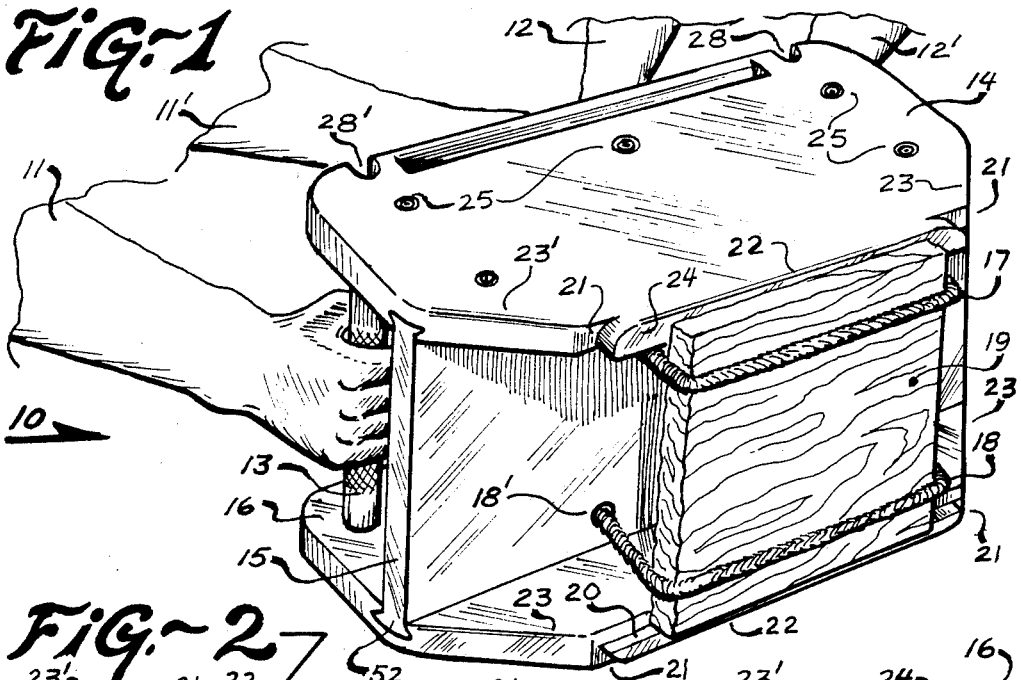
FIG.-2
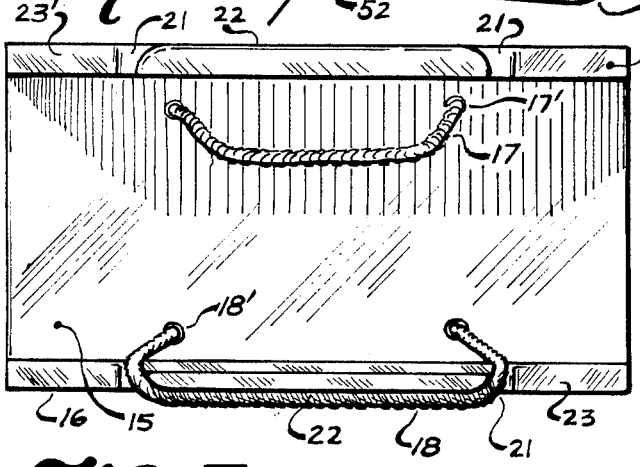
FIG.-3
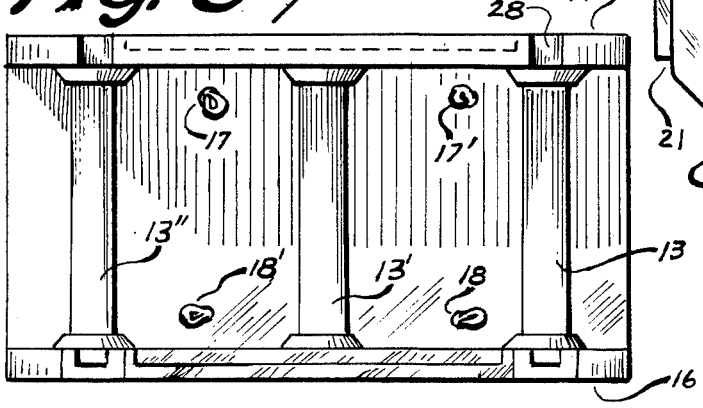
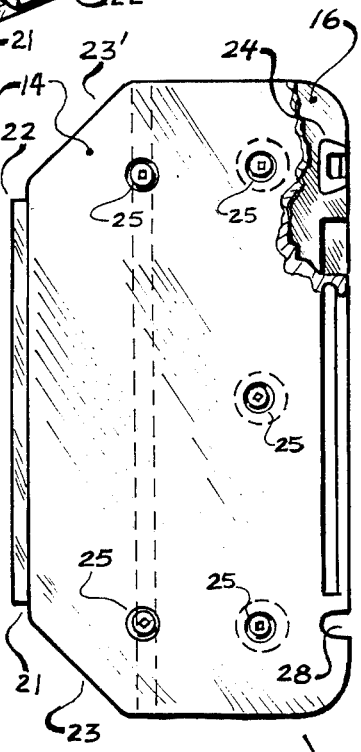
FIG.-4

PORTABLE KARATE BREAKING-BOARD HOLDER

BACKGROUND OF THE INVENTION

The present invention is directed to a karate breaking-board holder and, more particularly, toward such a device which is capable of holding a single or a plurality of boards. The breaking-board holder is portable and may also be releasably mounted to a flat surface.

The present invention provides a martial arts training device. Commonly, practitioners of karate and similar martial arts break boards with their hand and feet during training and competition. Usually, the karate practitioner strikes wooden breaking-board(s) held by one or more persons. Because it is often difficult for persons to steadily hold a board(s) in proper position, the usual practice presents a risk of injury to both the practitioner and others holding the board(s).

Mechanical devices for holding breaking-boards have been proposed. For example, U.S. Pat. No. 4,572,504 describes a box-like frame which is adapted to mounting on a wall or other similar surface. While this device addresses some of the problems of manually holding braking-board(s), it is not easily portable. Moreover, the construction of the device includes several sharp edges which may add to the risk of injury to the practitioner.

Similarly, a board-breaking device shown in an issue of *Black Belt* Magazine (January, 1976, Page 18) comprises a U-shaped frame adapted for mounting on a wall or floor and having opposed channel members for holding a board therein. This devcie, however, again has several sharp and dangerous edges. Moreover, side walls off the device are so elongated as to permit the boards, once broken, to trap the practitioner's hand or foot as the practitioner breakes through the boards.

SUMMARY OF THE INVENTION

A portable Karate breaking-board holder, having an elongated-shaped frame, having an elongated top plate, elongated bottom plate spaced beneath the top plate and an elongated fence plate perpendicularly disposed between and attached to both the top and bottom plates. The fence plate defines distal and proximal recesses between the top and bottom plates. The breaking-board holder further includes board seating mechanism disposed along the distal edges of the top and bottom plates for seating at least one breaking-board in a plane at an angle to a plane perpendicular to one of the top and bottom plates. The breaking-board holder further includes an attaching mechanism coupled to the I-shaped frame which secures at least one breaking board to the distal edges to said top and bottom plates. Finally, handles are coupled to the I-shaped frame within the proximal recess.

BRIEF DESCRIPTION OF THE DRAWINGS

The proceeding summary, as well as further objects, features, and advantages of the subject invention, will be more fully appreciated and clarified by reference to the following detailed drawings of the preferred embodiments, which are shown in accordance with the present Claims, wherein:

FIG. 1 is a full ¾ frontal pictorial view of the invention, showing how it is to be hand held by two attachments.

FIG. 2 is a full width, front elevation view of the invention, as it appears without the top plate top cord in a relaxed condition, while the bottom plate bottom cord is in a stretched condition;

FIG. 3 is a full width, rear elevation view of the invention;

FIG. 4 is a full area plan view of the invention, wherein the right rear corner portion is cut away so as to reveal the difference in the latching provided by the bottom plate;

DESCRIPTION OF THE PREFERRED EMBODIMENT

Figure 5:
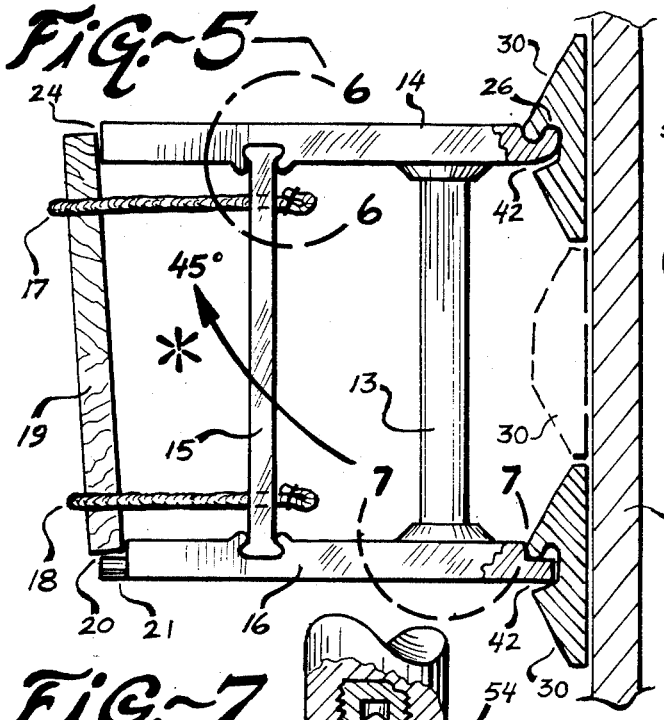
FIG. 5 is a full depth, side elevation view of the invention, including the preferred arrangement of "quick mount" slats and wall therewith.

FIG. 1 shows a breaking-board holder 10 comprised essentially of a top plate 14, fence plate 15, having dovetailed ends 52, and bottom plate 16. The top and bottom plates 14 and 16 are spaced apart from each other substantially the width of a breaking-board 19, which is intended to be held against the top and bottom plates at their distal edges 22 and 24, respectively. The bottom plate also features a groove 20 along the upper portion of it distal edge for seating one or more breaking-boards 19. The top plate has two notches 21 which are intended to releasably secure the top resilient cord 17 over the upper surface 22 of the plate adjacent to its distal edge 24. Similarly, the bottom plate has two notches 21 intended to releasably secure the bottom cord 18 to the plate's lower surface adjacent to its distal edge 22.

The top and bottom plates' distal edges are tapered rearward by chamfers 23, terminating at opposing edges of the fence plate 15. Additional features showing in FIG. 1 include upper assembly fasteners 25, and handles 13 suitable for holding by assistants 11 and 12. A pair of recesses 28 are located near the opposing ends of the distal edge of the top plate.

FIG. 2 shows, top and bottom cords 17 and 18, respectively, extending distally outward from the fence plate 15. Bottom cord 18 is shown secured in a stretched position over the lower surface of the distal edge 22 of the bottom plate 16 and releasably secured at notches 21. The upper cord 17 is shown in a relaxed position.

As shown in FIG. 3, the proximal recess of the holder 10 includes a plurality of handles 13 disposed along the proximal edge of the distal recess. The top view of FIG. 4 shows the opposing chamfered edges 23 of the top plate.

The holder of the present invention is utilized in the following manner. As shown in FIG. 5, a breaking-board 19 is seated on the groove 20 located at the upper portion of the/distal edge of the bottom plate and firmly secured against the distal edges 22 and 24 of the top and bottom plates, respectively, by the top and bottom resilient cords 17 and 18. It should be readily apparent that the resilient cords may be stretched to secure one or a plurality of boards.

Breaking board 19 when mounted against top and bottom plates 14 and 16 is positioned at an optimum angle of 2½ degrees from a plane perpendicular to one of the top and bottom plates 14 and 16. This angle, or "face-angle" creates an anti-smear condition in the breaking of a broad, or stack of boards. In order to achieve peak kinetic penetration in breaking the boards a performer's kick must not smear, or glance off the board, or stack of boards. The kick must essentially drive into the initial point of contact with the board, or boards for optimum board breakage. The angled positioning of the board, or boards presents them at a more positive attitude for best penetration of the performers's foot through the board, or boards.

Figure 9:
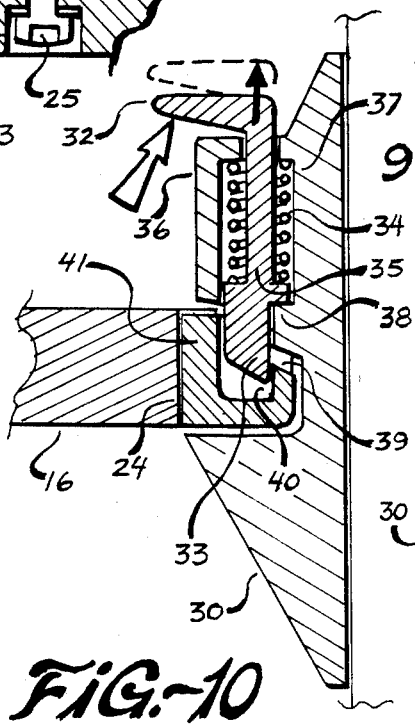
FIG. 9 is a central cross sectional view of the mounting slat, showing the preferred pivotal hanger provisions.

FIG. 5 also shows one method of securing the holder to a flat surface 31 by use of a mounting assembly 30, having a tongue 26 and groove 42 adapted for receiving the proximal edges of the top or bottom plates. FIG. 9 features a close detail of one such mounting assembly 30 coupled to a channel 42 in the top plate 14 by tongue 26.

Figure 8:
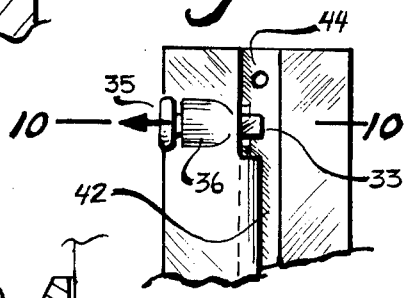
FIG. 8 is a full frontal view of the special quick mounting slat accessory of the invention.
Figure 8:
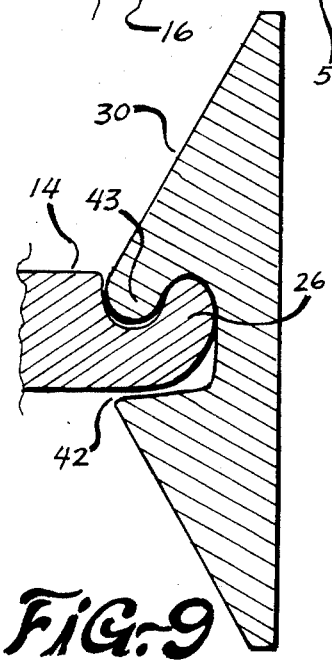
Figure 10:
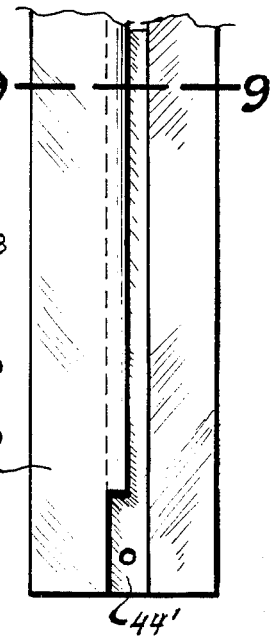
FIG. 10 is a detail cross sectional view of a preferred exemplary latch pin arrangement for more positive hanging.

Accordingly, FIG. 8 and 9 further reveal preferred features of the mounting plates, wherein it can be seen that the bottom plate includes two special lateral latching devices (FIG. 10) which act to prevent the bottom plate 16 from becoming disengaged by a Karate blow from the lower hanger or mounting assembly 30'. Additional features of FIG. 10 include the manually released latch pin lift tab 32 and latch paw 33 which are biased to the latched position shown by compression spring 34 which may encircle the latch pin shank 35 and is housed inside a suitably formed protuberance 36 forming an annular well 37 within the mounting assembly 30, while having a suitable travel stop entity 38 which limits travel of said latch paw 33 to the exact place where it can smoothly engage upon the latching ramp 39 until the latch catch 40 of the latch receiver 41 is springably engaged in a positive manner.

Further reference to FIG. 8 shows the method by which the trailing edge of the bottom plate 16 is received into the spanwise channel 42 of the mounting assembly 30'. The cross sectional view portion 9—9 is referenced to FIG. 9 so as to demonstrate in detail how the top plate 14 acts as the key hanger provision, whereby radiusly curved tongue 26 can only pivotaly enter the channel 42, and is held therein by presence of the tongue extension 43 which mates into groove 27. Accordingly, it is seen how channel 42 is able to accommodate the dual purpose of either the top or bottom plate aft ends, so as to facilitate the juxtapositioning of the plate ends according to the desired working height. Hence, one mounting assembly configuration serves the purpose regardless as to which Plate is being inserted therein the channel. Naturally, actual mounting of the mounting assembly 30 may be achieved by ordinary screw holes 44 and 44'.

Figure 6:
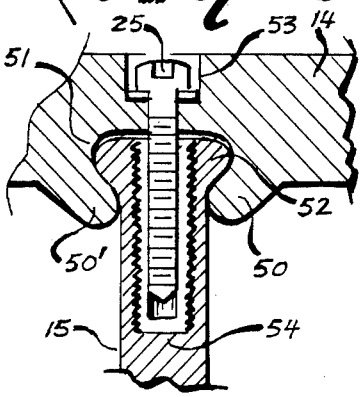
FIG. 6 is a slightly enlarged cross sectional detail view of the fence dove tail interlock attachment means.

Reference to FIG. 6 shows a detail of the fence dovetailing attachment method wherein the top plate 14 or bottom plate (not shown) preferably features extending shoulders 50 and 50' which gives substantial additional reinforcement to the integrated dove tailing female groove 51, which is shown here generously rounded so as to better resist possible dove-tail apex cracking which might occur if the dove-tailing were otherwise configure with relatively sharp engaging apex corners.

Figure 7:
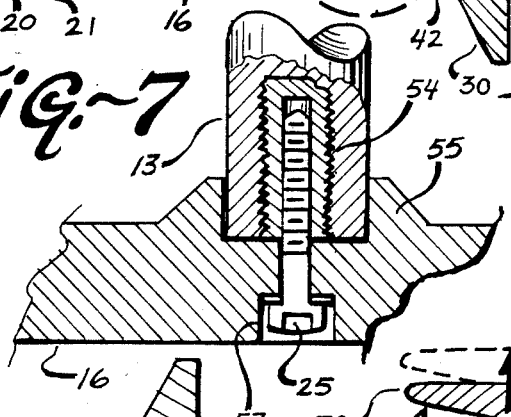
FIG. 7 is a slightly enlarged cross sectional detail view of the handle assembly.

Accordingly, fence plate 15 male dove-tailed top and bottom ends are formed with a matching hi stength rounded apex ends 52 so as to assemble in an easy slip fit manner, although the entire holder 10 could be made in a permanently assembled manner. Note here that the resulting sliding joint achieved by the dove-tailing method also allow sufficient splay apart of the aft trailing ends of the top and bottom plates 14 and 15 so as to also permit insertion of the handles 13, 13' and 13'' as illustrated in FIG. 7, just prior to installation of the preferably ten (10) identical assembly fasteners 25 which are all likewsie shown inset within suitable annular recesses 53 molded into the plate outer surfaces. Also not here that said assembly fasteners 25 securely screw into ten suitable threaded metal inserts 54 molded integrally within the said holding bars and fence plate members. FIG. 7 also shows a preferred annular reinforcement shoulder 55 which is integrally molded into the top and bottom plates.

The present invention may be embodied in other specific forms without departing from the spirit or essential attributes thereof and, accordingly, reference should be made to dependent claims rather than to the foregoing specification as indicating the scope of the invention.

What is claimed is:

1. A portable karate breaking-board holder, comprising:

an elongated I-shaped frame having an elongated top plate, an elongated bottom plate spaced beneath said top plate and an elongated fence plate perpendicularly disposed between and attached to both the top and bottom plates, said fence plate defining distal and proximal recesses between the top and bottom plates;

breaking-board seating means disposed along the distal edges of said top and bottom plates for seating at least one breaking-board in a plane at an angle to a plane perpendicular to one of the top and bottom plates;

breaking board attaching means coupled to said I-shaped frame for securing at least one breaking-board to said distal edges of said top and bottom plates; and handle means coupled to said I-shaped frame within said proximal recess for holding said frame.

2. The breaking-board holder of claim 1 wherein said breaking-board seating means further comprises a groove disposed along the upper portion of the bottom plate distal edge.

3. The breaking-board holder of claim 1 wherein said breakingboard attaching means comprises at least one resilient cord each having two ends, said ends attached to said fence plate such that each cord forms a loop adjacent the distal recess.

4. The breaking-board holder of claim 1 wherein said handle means comprises at least two handles disposed along the length of and inset within the proximal recess, each handle having opposing axial ends attached to said top plate and bottom plate.

5. The breaking-board holder of claim 1 wherein the opposing ends of the distal edges of the top and bottom plates taper towards opposing edges of the fence plate.

6. The breaking-board holder of claim 1 wherein said distal edges each have at least two notches for securing each resilient cord to the frame as each cord is stretched.

7. A portable karate breaking-board holder, comprising:

an elongated I-shaped frame having an elongated top plate, an elongated bottom plate spaced beneath said top plate and an elongated fence plate perpendicularly disposed between and attached to both the top plate and bottom plate, said fence plate defining distal and proximal recesses between the top plate and bottom plate;

said bottom plate having a groove along the upper portion of its distal edge for seating at least one breaking-board in a plane at an angle to a plane defined by the fence plate;

at least one resilient cord each having two ends, said ends attached to said fence plate such that each cord forms a loop within said recess; and at least two handles disposed along the length of an inset within said proximal recess, each having opposing axial ends attached to said top plate and said bottom plate.

8. The breaking-board holder of claim 7 wherein the opposing ends of the distal edges of the top plate and the bottom plate taper towards opposing edges of the fence plate.

9. The breaking-board holder of claim 7 wherein said distal edges each have at least two notches for securing the loop formed by each resilient cord to the frame as each cord is stretched.

* * * * *